US005178492A

United States Patent [19]

Meheen

[11] Patent Number: 5,178,492

[45] Date of Patent: Jan. 12, 1993

[54] METHOD AND APPARATUS FOR ANCHORING BACKFILLED WALL STRUCTURES

[76] Inventor: H. Joe Meheen, 1860 Lincoln St., Denver, Colo. 80295

[21] Appl. No.: 152,765

[22] Filed: Aug. 30, 1991

[51] Int. Cl.[5] ..... E02D 29/02

[52] U.S. Cl. ..... 405/284; 405/262; 405/286

[58] Field of Search ..... 405/258, 262, 272, 273, 405/280, 281, 284, 285, 286

[56] References Cited

U.S. PATENT DOCUMENTS 785,274 3/1905 Schleussner ..... 405/280
912,020 2/1909 Neilson ..... 405/281
1,019,227 3/1912 Desoer ..... 405/280
4,312,606 1/1982 Sarikelle ..... 405/286
4,664,562 5/1987 Clark et al. ..... 405/273
4,884,920 12/1989 Perazzi ..... 405/284
4,914,876 4/1990 Forsberg ..... 405/286 X
4,914,887 4/1990 Meheen ..... 405/284

*Primary Examiner*—David H. Corbin

[57] ABSTRACT

A modular retaining wall comprising a plurality of tie-back units with a plurality of retaining wall panels therebetween. Each tie-back element is shaped substantially similar to each retaining wall panel. Each element comprises a main body with a cored cavity, a neck at each end of said main body, and a column attached to each neck. Each neck on the tie-back element has opposing concave surfaces for mating with the convex surface of each column of the soil-retaining element.

5 Claims, 2 Drawing Sheets

Fig_3
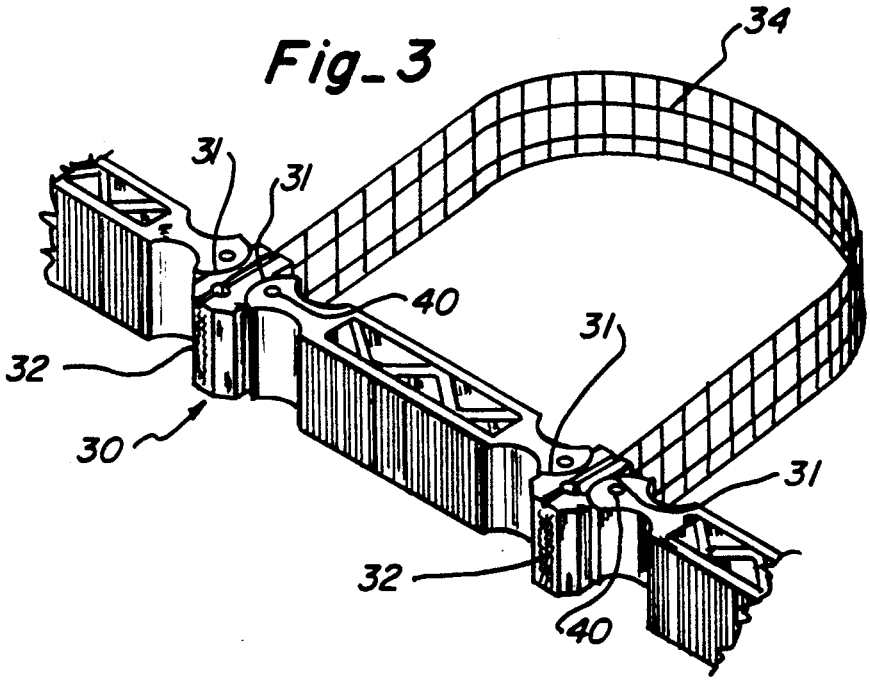
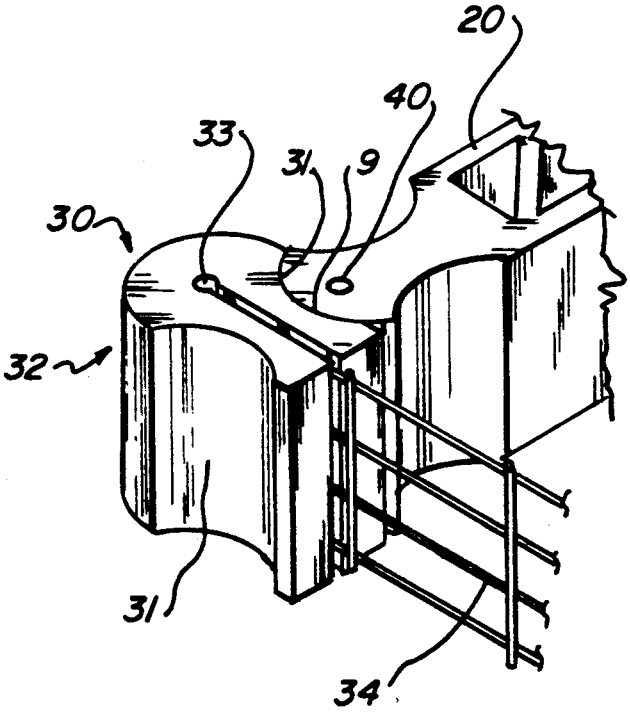
Fig_5
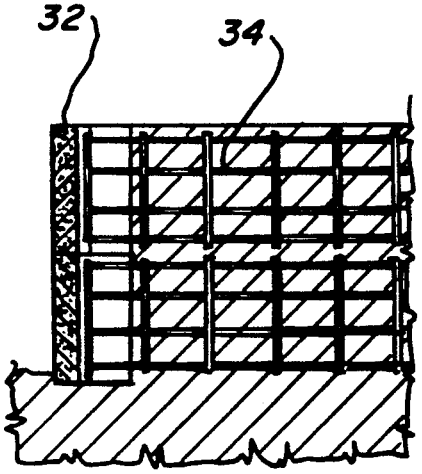
Fig_4

METHOD AND APPARATUS FOR ANCHORING BACKFILLED WALL STRUCTURES

BACKGROUND OF THE INVENTION

The instant invention relates to a modular assembled retaining wall formed of precast concrete, plastic or other material. The retaining wall can be used for landscaping, terracing, slope protection, noise barriers, and erosion control.

In the past, retaining walls have been formed of a plurality of standardized block units which have been assembled one on top of each other to a desired elevation without the use of mortar. Such a system is shown in U.S. Pat. No. 3,282,054. In the prior art, the entire retaining wall uses the same basic foundation since each of the blocks of the entire wall rests on and is dependent upon the blocks immediately below. This limits the versatility and application of the wall. This stacking of blocks can also result in a compacting of the soil fill.

U.S. Pat. No. 4,050,254 to Meheen et al. discloses a modular retaining wall system having a plurality of precast tie-back elements in a laterally spaced relationship along a grade line. The tie-back elements include upright columns against which a retaining panel is arranged to span the lateral space between pairs of tie-back elements. The panels of the prior art patent have a concave cross-section, i.e., circular or elliptical arch, in horizontal plan view so as to resist the load from the compacted soil fill in compression. A disadvantage of the arched panels of the patent lies in the fact that the panels could be subject to cracks if the ends of each panel were not completely contained or covered by the tie-back members. The cracks are the result of the application of bending stresses imposed by the retained earth.

Another prior art curved retaining wall system is shown in U.S. Pat. No. 4,341,491 to Neumann. The patent discloses curved frontal wall panels mounted to frontal wall support members which are in turn attached to a curved rear wall through tension members. Such a system is quite complex, and again, the front curved panels can be subject to cracking.

Retaining walls with straight wall elements are shown in U.S. Pat. No. 4,707,962 to Meheen. The retaining wall system of Meheen discloses the use of curved retaining wall panels also and straight elements used as tie-backs. The use of the two different wall elements requires separate castings and separate molds.

The prior art wall panels and elements disclosed above were each cast separately which can also be a time-consuming and expensive procedure.

It is an object of the instant invention to provide a retaining wall system which uses the same structural element for both the tie-back and the soil retaining panel.

It is a further object of the instant invention to provide a wall panel for a retaining wall which can resist cracking under flexure forces.

It is an additional object of the instant invention to provide a method for simultaneously casting a plurality of elements for a retaining wall.

It is a further object of the instant invention to provide a wall panel for a retaining wall which presents a flat face, but is also structurally strong and can securely mate with a column of a tie-back.

SUMMARY OF THE INVENTION

The present invention provides a retaining wall and method which utilize modular structural units, such as precast strengthened concrete or plastic units, which may be mass produced away from the construction site, stored as desired, and then easily erected with a minimum of skill and supervision. More specifically, a novel "tie-back" component is provided for placement and support of soil retaining panels and for transmitting soil pressures on such panels back into the soil mass while resisting pullout or other unwanted movement of the wall. The result is a retaining wall possessing high strength, stability, and durability.

Using the wall system of the present invention, a plurality of retaining wall tiers can be erected independently of each other to a desired elevation in a continuous sequential fashion or at desired intervals.

Objectives of the invention are achieved by utilizing a plurality of tie-back elements comprising integral wall forming and wall retaining structure. These stress supporting and transmitting components are placed on a suitable foundation above which an embankment is to be constructed utilizing soil fill to another grade level. Retaining panels span the lateral space between adjacent pairs of such tie-back with a mating positive interconnection between these module structures. Each of the tie-back elements include vertically oriented columns for securely mating with soil retaining panels.

In the preferred embodiment, the tie-backs elements are of the same shape and configuration as the wall or soil retaining components. Each tie-back is formed with a cored cavity with truss-like spans. The cored cavity portion spans between two columns each of which forms a half of a cylinder or a column. A curved neck of reduced dimension lies between the cored cavity and each cylinder.

The legs of the tie-back elements project into the embankment a substantial distance from the base of the column so as to transmit pressure from the retaining panels back into the earth's mass. The height of the column portions of the tie-back elements can vary depending on the particular embankment to be constructed. The length of the leg portion is largely a function of soil stability conditions.

Each wall retaining component is of a similar shape as the tie-backs. Each wall retaining panel has a cored cavity with truss-like spans. The cored cavity portion spans between two columns, each of which forms a half-cylinder. A curved neck of reduced dimension having opposing concave surfaces lies between the cored cavity and each cylinder. The convex shaped column of each element used as a wall retaining element mates with the concave curve in the neck of each tie-back element.

In an alternative embodiment, each wall retaining element mates with a key-holed column. Wire mesh or webbing extends in the keyhole to anchor the wall retaining elements.

The invention also provides a method of simultaneously casting a plurality of retaining panels and/or tie-back elements utilizing low-slump concrete. The wall elements are cast as siamese twins, mating along one of the flat surfaces forming the cored cavity. a "V" shaped groove is cast along the dividing line between the two "Siamese" elements, providing a starting point for a blade to split the two elements apart after curing to achieve a flat frontal face with desirous attractive textural effects. In the casting process a vertical hole is cast in each column element to provide for a seat for a rod or rigid shaft to key additional similar units which may be stacked to provide additional tiers.

Other features and advantages of the present invention will be brought out in the following more detailed description of a specific embodiment made in conjunction with the accompanying drawings.

BRIEF DESCRIPTION OF THE DRAWINGS

FIG. 3 is a perspective view of an alternative embodiment of the instant invention.

FIG. 4 is an enlarged fragmentary front view showing the mating between a column and a soil retaining panel.

FIG. 5 is a an enlarged fragmentary perspective view of the joint between the wall element and the alternative column element, as shown in FIG. 3.

DETAILED DESCRIPTION OF THE PREFERRED EMBODIMENT

Figure 1:
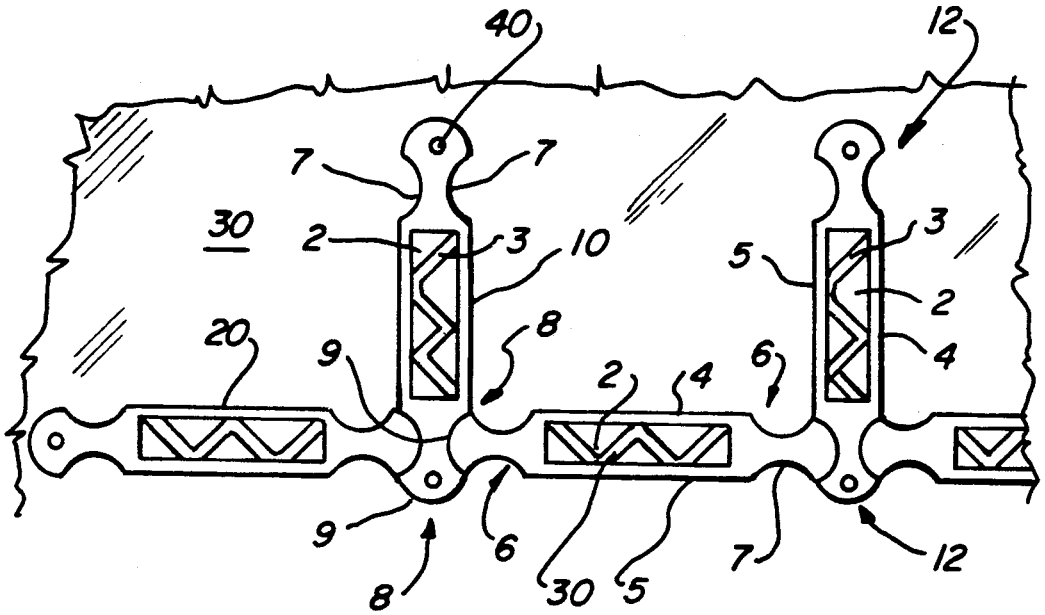
FIG. 1 is a top view showing the soil retaining wall elements and tie-back elements of the instant invention.

FIG. 1 discloses a retaining wall utilizing the elements of the instant invention. Tie-back elements 10 are laterally spaced with soil-retaining panels 20 therebetween. The back-fill of the embankment to be retained is shown at 30. As each tie-back element 10 is substantially identical to each soil retaining panel 20, like reference numerals have been used.

Each element comprises a first wall 4, a second wall 5, and two end portions generally denoted as 12. A cored cavity 2 is formed by the walls 4 and 5, and the end portions 12. Truss-like members 3 span each cored cavity 2 for added strength.

Each end portion 12 has a narrowed neck 6, having two opposed concave surfaces 7. An upstanding column portion 8 has a convex surface 9 extending from the narrowed neck portion 6. Each column portion is cast with a vertical hole 40 for receiving a rod or shaft for keying a superimposed tier of stacked similar elements.

In the preferred embodiment, the wall 5 forming the front frontal face of the soil retaining panel has an attractive textured surface.

Figure 2:
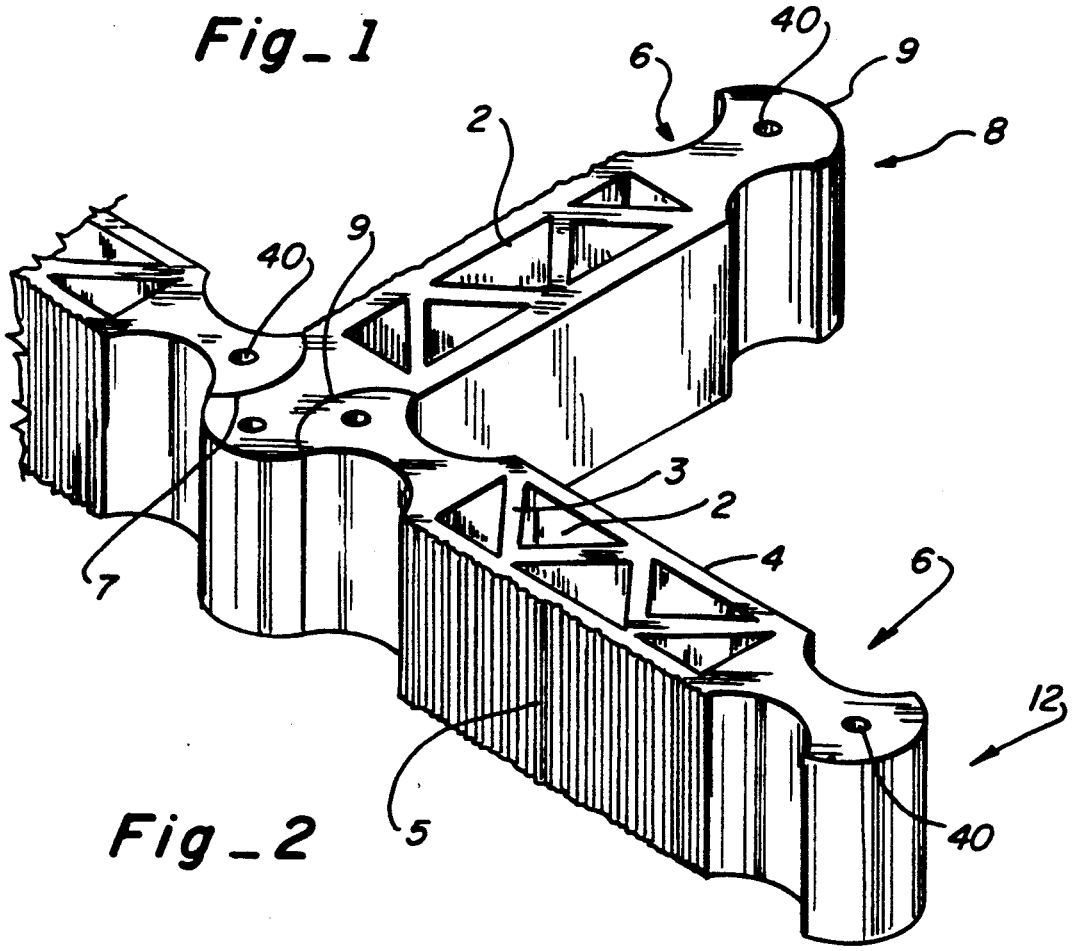
FIG. 2 is an enlarged fragmentary perspective view showing the mating between a tie-back element and soil retaining panels.

The secure and positive mating cooperation between the tie-back and soil retaining elements will now be described with particular reference to FIG. 2. Concave surfaces 7 of each tie-back mate with the associated convex surface 9 of the column of an adjacent soil-retaining panel 20. The tie-back is secured in position using the backfill and, because of the mating relationship, the column end 8 of each tie-back aids in holding each soil-retaining panel in position. The tie-backs 10 can be positioned so that the soil-retaining panels 20 will be perpendicular to the grade line or they can be angled to achieve another angle of the soil retaining panels.

FIG. 3 discloses an alternative embodiment in which columns 30 have concave surfaces 31 and convex column front 32 is used instead of the tie-back, as shown in my U.S. Pat. No. 4,914,887. The concave surfaces 31 of the column mate in a secure and positive manner with the convex surface of the adjacent soil retaining panel 20. Each column 30 is provided with a keyhole shaped slot 33. Webbing 34 or mesh of wire or other suitable material is anchored in the keyhole. Backfill is placed around the webbing 34 which aids in anchoring the columns 30 in place. Re-bar or reinforcing rod can also aid in securing the columns. Each column 30 in turn through the mating surfaces 31 and 9 retains the soil-retaining panels in position.

The tie-back and soil retaining elements of the instant invention can be tacked to achieve a retaining wall of desired height. They can also be offset to form tiers which retain soil at different grade elevations. The elements can also be used to form a noise barrier wall if required.

In the preferred embodiment, the symmetrical shape of each element 10 and 20 allows for ease in casting and use. The installer does not have to differentiate between tie-back or retaining panel installation. Each element can also be cast prior to delivery and assembled on site.

Each element is a unitary prefabricated structure, cast of concrete or molded of plastic or metal. For ease of casting in concrete and for added strength, it is preferable to use a low water-to-cement ratio, or "low-slump" concrete. That is, the concentration of water is low compared to the amount of concrete used. The casting requires only enough water to form the concrete in the mold. The precast concrete structure can also be strengthened by pre-stressing, post-tensioning, or other means known in the art.

Although each tie-back element and each soil-retaining element can be cast separately, it is preferable and desirable to cast a plurality simultaneously. FIG. 5 diagrammatically illustrates the simultaneous casting technique. A mold or form can be provided (shown diagrammatically at 40). The mold has channels to receive the concrete in the shape of the element and is arranged so that adjacent walls 5 of each element will be molded simultaneously as one wall. A tie-back element is illustrated as being molded simultaneously with a soil-retaining element, although because of the symmetrics involved, a plurality of tie-backs could be cast together as well as a plurality of soil-retaining elements.

For casting, a low water-to-concrete ratio concrete is used. After hardening and removal of the mold or form, the resulting cast form is split in two between the walls 5. This splitting provides wall 5 with an attractive textured front face. A groove 41 can be formed between walls 5 during casting to facilitate the splitting process. Other materials or rods can also be placed to aid the splitting and achieve the desired effects.

Because of the relatively flat walls of the tie-back element and the soil-retaining elements, a number of such elements can be cast simultaneously, the number being limited by the maximum size dimensions of the mold or form.

Strengthened precast concrete structures are practical and economical for most applications of the invention, however, the modular elements could be constructed from other suitable materials such as steel, plastic reinforced fiberglass, etc.

In the light of the present teachings, various wall shapes and configurations can be devised without departing from the principles of the present invention. Such modifications and configurations would be obvious to one of ordinary skill in the art.

I claim:

1. Structure for a modular assembly for retaining soil, comprising in combination at least a pair of laterally spaced tie-back elements, each tie-back element comprising, a first wall,
a second wall,
a first end portion connecting said first and second walls;
a second end portion connecting said first and second walls,
said first and second walls and said first and second end portions forming a first cored cavity therebetween,
each said first and second end portions comprising
a first column end, and
a first neck connecting said first column end to said first and second walls,
a soil-retaining panel spanning such lateral space between each said pair of tie-back elements, each said retaining panel comprising:
a third wall,
a fourth wall,
a third end portion connecting said third and fourth walls,
a fourth end portion connecting said third and fourth walls,
said third and fourth walls and said third and fourth end portions
forming a second cored cavity therebetween,
each said third and fourth end portions comprising:
a second column end, and
a second neck connecting said second column end to said third and
fourth walls, and
wherein said first neck of said tie-back comprises opposing concave outer surfaces, and wherein each said second column of said soil-retaining panel comprises a convex outer surface for mating with said concave neck surfaces of said laterally spaced tie-back elements.

2. The structure of claim 1 wherein each back element is symmetrical about perpendicular longitudinal and lateral axes.

3. The structure of claim 1 wherein said soil retaining panel is identical to the tie back elements.

4. The structure of claim 1 and further comprising at least a second soil-retaining panel and at least a second pair of tie back elements disposed in stacked relation on the first pair of tie back elements and soil retaining panel.

5. The retaining structure of claim 1 comprising truss-like spans in said first and second cored cavities.

* * * * *